US007060041B1

(12) United States Patent
Weil et al.

(10) Patent No.: US 7,060,041 B1
(45) Date of Patent: Jun. 13, 2006

(54) CHEST COMPRESSOR

(75) Inventors: Max Harry Weil, Northbrook, IL (US); Joe Bisera, Camarillo, CA (US); Clayton Young, San Leandro, CA (US); Wanchun Tang, Palm Desert, CA (US)

(73) Assignee: Institute of Critical Care Medicine, Rancho Mirage, CA (US)

( * ) Notice: Subject to any disclaimer, the term of this patent is extended or adjusted under 35 U.S.C. 154(b) by 911 days.

(21) Appl. No.: 09/678,616

(22) Filed: Oct. 4, 2000

(51) Int. Cl.
*A61H 31/00* (2006.01)
*A61H 7/00* (2006.01)

(52) U.S. Cl. ..... 601/41; 601/106

(58) Field of Classification Search ..... 601/41–44, 601/107, 108
See application file for complete search history.

(56) References Cited

U.S. PATENT DOCUMENTS 3,307,541 A * 3/1967 Hewson ..... 128/145.8
3,396,721 A * 8/1968 Mencacci ..... 128/41
3,511,275 A * 5/1970 Hewson ..... 137/596.15
3,610,233 A * 10/1971 Barkalow ..... 128/53
3,978,854 A * 9/1976 Mills, Jr. ..... 128/204.26
4,361,140 A * 11/1982 Barkalow ..... 128/53
4,554,910 A * 11/1985 Lally ..... 446/415
4,602,728 A * 7/1986 Ha ..... 222/528
4,624,382 A * 11/1986 Tontarelli ..... 220/8
4,664,098 A * 5/1987 Woudenberg ..... 128/53
4,702,231 A * 10/1987 Arpin ..... 601/105
5,399,148 A * 3/1995 Waide et al. ..... 601/41
5,743,864 A * 4/1998 Baldwin, II ..... 601/41
5,936,765 A * 8/1999 Walsh ..... 359/399
6,056,164 A * 5/2000 Wakayama ..... 222/327

FOREIGN PATENT DOCUMENTS

JP 411301484 A * 11/1999

* cited by examiner

*Primary Examiner*—Gregory L. Huson
*Assistant Examiner*—Fenn C. Mathew
(74) *Attorney, Agent, or Firm*—Leon D. Rosen

(57) ABSTRACT

Apparatus for compressing the chest of a patient to stimulate blood circulation, includes a torso wrap (32) that has a back portion (40) lying at the back of the patient's chest and a front portion (42) lying at the front of the patient's chest, and includes a compressor assembly with an actuator (16) having a pressing member (12) that can apply a series of force pulses to the sternum of the patient to stimulate blood circulation. The actuator is energized by pressured fluid, with a controlled pressured fluid source (20) connected by an elongated flexible hose (24) to the actuator so the pressured fluid source and a control (22) can lie on the ground and only the actuator lies on the torso wrap. The actuator includes a cylinder (66) and a plurality of telescoping piston parts (64, 66) to provide a long stroke in an actuator of small height. A stabilizer (150) that limits tilt of the actuator from the vertical, includes a saucer-shaped member that presses against the front of the patient.

2 Claims, 3 Drawing Sheets

CHEST COMPRESSOR

BACKGROUND OF THE INVENTION

Low systemic profusion is caused by several forms of circulatory shock, including hemorrhage, sepsis, and cardiac arrest, all of which cause large system-wide harm to vital organs. A first mode of damage results from the sudden decrease in oxygen delivery to cells, while a second mode of damage results from the inability to remove cellular waste products such as $CO_2$.

Stimulation of circulation is commonly accomplished by applying pressure pulses to the chest. This can be accomplished by placing a torso wrap around the patient, and attaching a chest compressor to the front of the torso wrap. The actuator applies downward pressure pulses to the patient's chest while the torso wrap holds down the actuator.

In order for a chest compressor system to be widely used, it must be compact and easily attached to the patient. In some cases, a rescuer may be positioned so it is most convenient for him/her to attach the torso wrap by slipping the part with the chest compressor under the patient. A chest compressor of small height aids in such attachment. It is important that the chest compressor lie with its axis normal to the patient's chest and not tilt by more than several degrees from that orientation. A chest compressor system with a compact and light weight actuator for actually compressing the chest, would be of value.

SUMMARY OF THE INVENTION

In accordance with one embodiment of the present invention, an apparatus is provided for applying compressions to the chest of a patient to stimulate circulation, which is compact, of light weight, and reliable. The apparatus includes an energizable compressor assembly with a pressing member that can apply a series of pulses to the chest of the patient, and a torso wrap that wraps around the back of the patient's torso so the patient's torso is sandwiched between the compressor and the back portion of the torso wrap. The compressor assembly includes an actuator that is energized by pressured fluid such as pressured gas and that is coupled to the torso wrap. The compressor assembly also includes a fluid source and control that are coupled through an elongated flexible tube to the actuator so the pressure source and control can lie on the ground beside the patient. The control includes a valve that briefly opens periodically to send pulses of air to the actuator to cause the pressing member to be depressed in pulses.

The actuator can include a cylinder connected to the torso wrap and a piston that slides vertically within the cylinder. The piston includes a plurality of piston parts that telescope to provide a long stroke in an actuator of small height.

A stabilizer includes a plurality of leg portions with inner ends connected to the actuator and outer ends that press against the person's chest to prevent tilt of the actuator. The stabilizer can be formed by a saucer-shaped member of greater diameter than the pressing member. The torso wrap can include an eyelet attached to one side of the stabilizer and a strap that extends from the opposite side of the stabilizer and around the patient, with an end portion of the strap threaded through the eyelet and tightened, with Velcro pads on the strap holding the strap in its tightened position.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
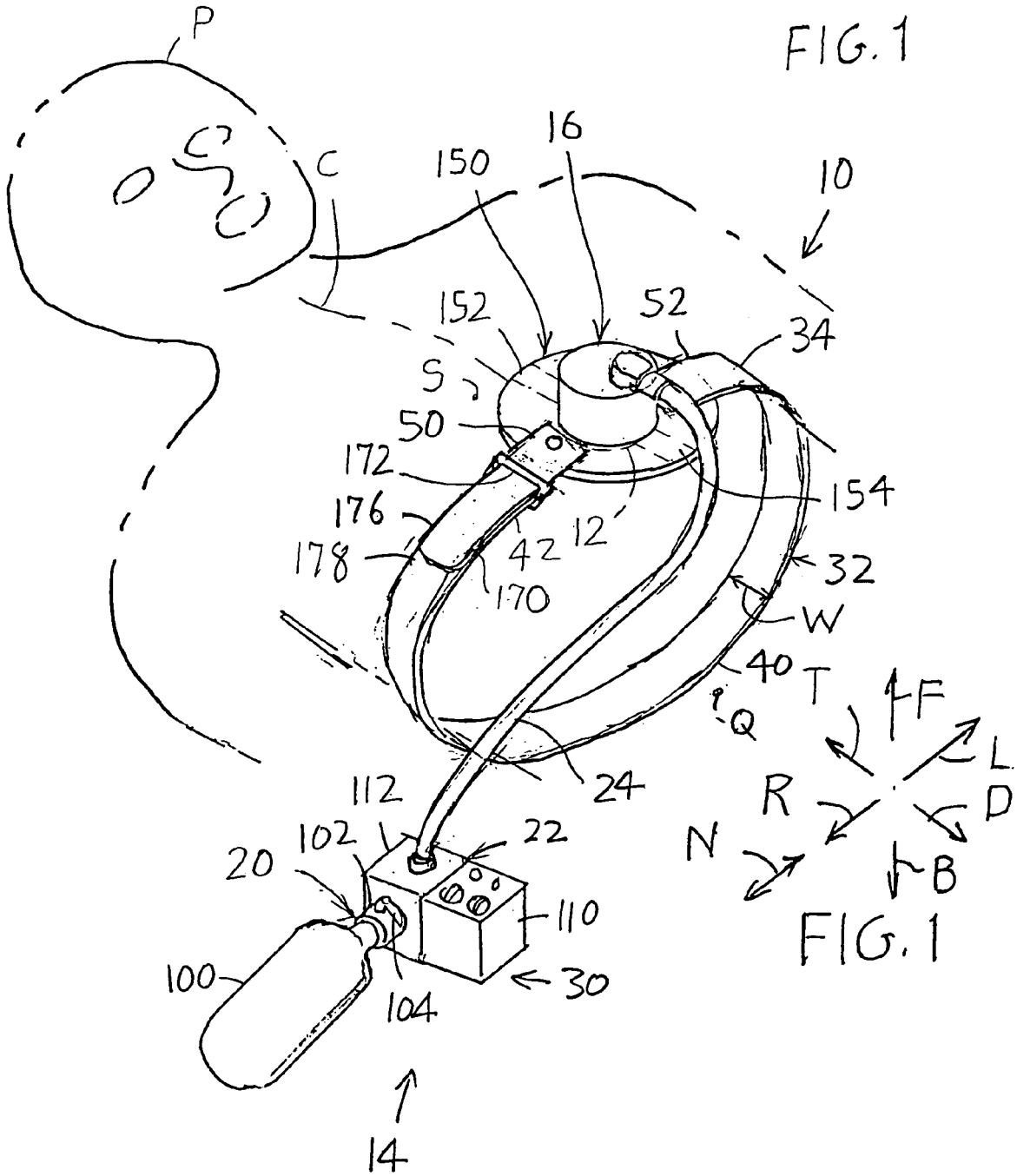
FIG. 1 illustrates a patient who is reclined on a floor and who is being treated for dangerously low profusion, such as may exist for a patient undergoing a heart attack.

FIG. 1 illustrates a patient P who has a dangerously low blood circulation such as might occur in a heart attack. An apparatus 10 of the invention includes a compression assembly 14 with a pressing member 12 having a diameter of about three inches, which can be forcefully pushed down against the sternum S of the patient's chest in a series of pulses, to stimulate the heart of the patient. For an adult male patient, the pressing member 12 can press down with a maximum force of about 100 to 120 lbs., in pulses spaced by perhaps ½ to 1 second apart. This mimics the chest compressions applied in CPR (cardiopulmonary resuscitation).

The compression assembly 14 includes an actuator 16 that forces down the pressing member 12 in pulses, a pressure source 20 that supplies pressured air for energizing the actuator, and a control 22 that controls the application of pressure to the actuator. An elongated flexible tube 24 connects the remote part 30 of the compressor assembly that lies on the ground, to the actuator 16 that lies over the patient's chest.

The apparatus 10 includes a torso wrap 32 which includes a belt or band 34 that extends largely around the upper torso of the patient. The band has a back portion 40 that lies at the back Q of the patient and a front portion 42 that lies at the front of the patient. A first end 50 of the band is coupled to one side of the actuator 16 while an opposite second end 52 of the band is coupled to the opposite side of the actuator. The opposite sides of the actuator are spaced in a lateral direction N which extends in left L and right R directions of the patient. When the actuator 16 is energized, it pushes the pressing member 12 in a downward or backward B direction, while the rest of the actuator 16 tends to move in a forward F direction relative to the patient. During such downward pulses of the pressure member 12, the actuator 16 and opposite sides 50, 52 of the band front portion move forwardly, with such movement resisted by the back portion of the band.

Figure 2:
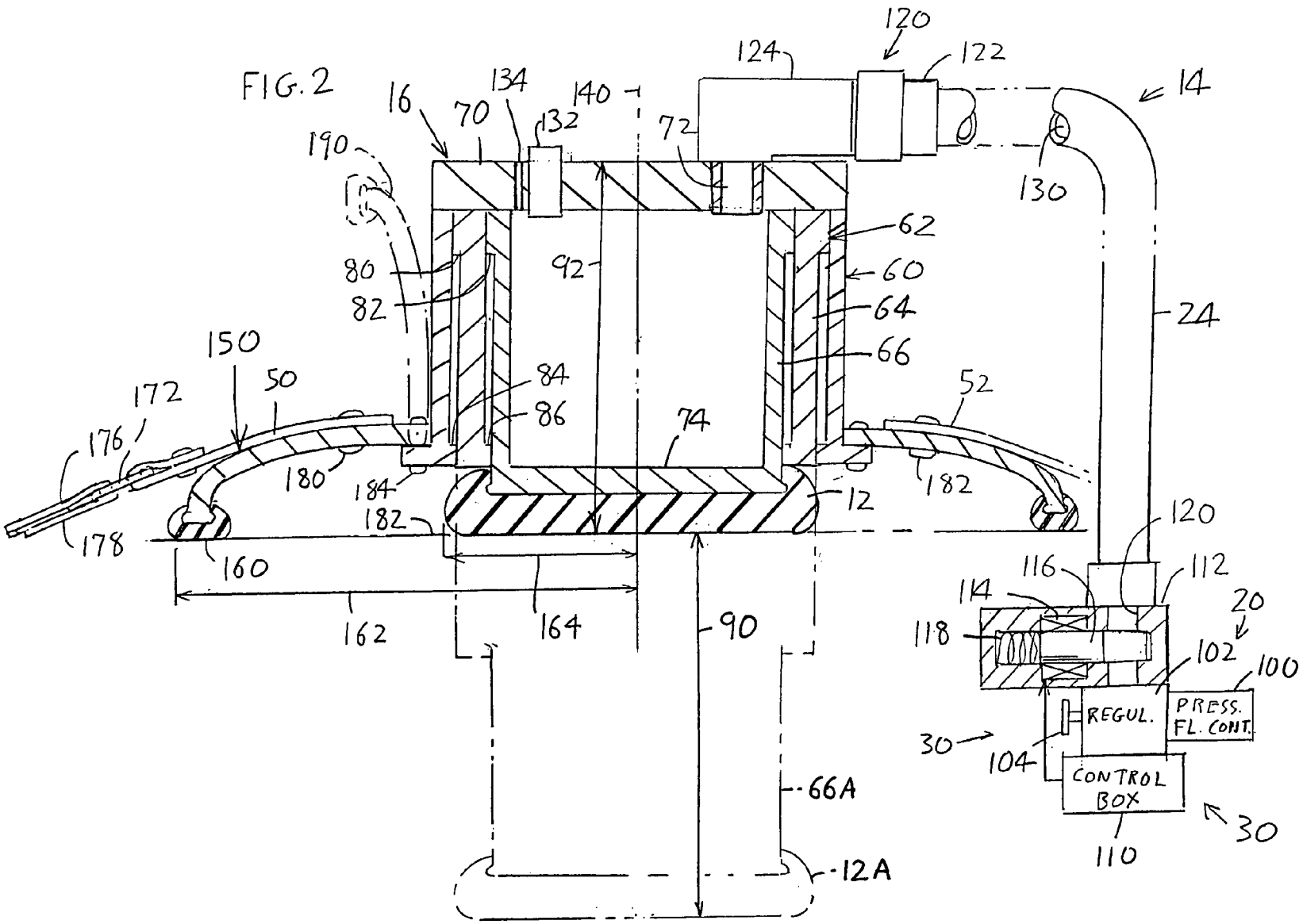
FIG. 2 is a sectional view of the compressor assembly of FIG. 1.

FIG. 2 shows details of the compressor assembly 14, including the actuator 16 and the remote portion 30. The actuator 16 includes a cylinder 60 and a piston 62 largely within the cylinder. The particular piston 62 includes two piston parts including upper and lower piston parts 64, 66. A cap 70 covers the top of the cylinder, while the pressing member 12 is mounted on the bottom of the inner, or lower piston part 66. When pressured air is supplied through an inlet 72 to the inside of the cylinder, such pressured air presses downward against the inner piston part 66, especially its large area bottom inner surface 74. This compresses the patient's chest. The maximum downward travel of the pressing member 12 and inner piston part 66 are shown at 12A and 66A. At that position, shoulders 80, 82 on the piston parts engage corresponding shoulders 84, 86, one on the cylinder and one on the outer piston part. The maximum downward stroke 90 can exceed the actuator height 92. It is clear from FIG. 2 that the inside diameter of the lower piston part 66 is more than half the inside diameter of the cylinder 60.

The pressure source 20 is shown as including a pressured fluid container 100 and a regulator 102. The pressured fluid container 100 may, for example, include a large carbon dioxide cartridge that contains gas under high pressure that may exceed 1,000 psi. The regulator 102 allows only a much lower pressure such as 80 psi to pass through it, with an adjuster 104 provided to vary the applied pressure. The control 30 includes an electronic control box 110 and a valve 112. The control box 110 supplies current pulses to a solenoid 114 of the valve to withdraw a valve member 116 against the force of a spring 118. The withdrawn valve member allows pressured air to flow through a passage 120 and through the flexible elongated tube 24 into the inlet 72 of the actuator.

The tube 24 has a large diameter inside 130, such as ⅜ inch (0.375 inch), so that a high pressure pulse is rapidly transmitted through the tube to the actuator. Actually, the maximum pressure in the cylinder is only about one-fourth of the pressure output of the regulator, depending on tube and cylinder size, etc. If a small diameter tube (e.g. 0.1 inch I.D.) were used, then rapid pulses of air of sufficient volume could not be delivered from the regulator (at 80 psi) through a tube of over 20 cm length so as to sufficiently rapidly depress the pressing member 12 for adequate CPR. The tube 24 has a minimum length to rapidly pass gas pulses through it, although a length of at least about 1.5 feet is generally necessary. A safety valve 132 allows the escape of gas of high pressure (e.g. over 20 psi) in the cylinder. Gas rapidly leaks out of the piston through an exit 134.

It would, instead, be possible to provide a pressured gas storage compartment that was fixed to the actuator 16 to supply pressured pulses through a valve to the actuator. However, this would increase the height and weight of the apparatus that was fixed to the torso wrap. Instead, applicant minimizes the weight, and especially the height of the actuator 16 by providing controlled air pulses through a remote portion 30 that rests on the ground. A quick connect coupling 120 enables a fitting 122 at the outer end of the tube 24 to be rapidly attached to a fitting 124 on the actuator for rapid connection.

The actuator has a vertical axis 140 which should be maintained within about 5° from a vertical direction when the patient's chest location 182 that is being compressed lies in a horizontal plane. The band 34 shown in FIG. 1 has a width W such as 2 inches for compact storage and easy deployment, and provides some resistance to tilt of the actuator axis. However, even if the flexible band were much wider, it would not apply much resistance to actuator tilt. To prevent such tilt, applicant provides a stabilizer 150. The stabilizer has at least two leg portions 152, 154, one lying in an upward direction T from the actuator and the other 154 lying downward D from the actuator. This prevents tilt of the actuator about a lateral axis N, with the tightened bands providing some resistance to tilt about a perpendicular horizontal axis. Preferably, applicant provides many leg portions spaced about the axis. The particular stabilizer 150 is in the form of a saucer, or saucer-shaped element. FIG. 1 shows that the saucer extends by more than a half circle (more than 180°) about the actuator axis, and actually extends approximately 360° about the actuator axis. As shown in FIG. 2, the stabilizer has one or more outer ends 160 spaced a radial distance 162 from the axis 140 that is considerably more than the radius 164 of the pressing member 12. With at least three and preferably at least four locations angularly spaced about the axis 140; lying against or very close to the location 182 of the chest that is being compressed, applicant prevents more than a few degrees of tilt of the actuator. The radius of the stabilizer outer ends is preferably more than that of the pressing member but not more than three times as great.

To install the apparatus 10 (FIG. 1) on a person, a rescue worker slips an end portion 170 of the band under the person's back, and then threads the tip of the band end through an eyelet 172 on a short band part 176. The person pulls on the band end part 176 that has passed through the eyelet until the band is tight on the person. Then, the band end part 176 is pressed against another band end part 178, with both parts 176, 178 having Velcro (hook and loop type fasteners) pads to prevent loosening of the belt. As also shown in applicant's FIG. 2, the band ends 50, 52 can be fastened by rivets 180, 183 to the stabilizer 150. The stabilizer is fastened by rivets 184 to a flange on the cylinder of the actuator.

It is possible for the stabilizer to be formed by a plurality of feet or legs 190 that can be pivoted up (or horizontally) out of the way for storage and later pivoted down and locked in the down position. However, applicant prefers to use the saucer-like stabilizer, shown for simplicity.

When mounting the chest compressor assembly on the patient, applicant prefers to place the center of the pressing member 12, at its axis, about two inches above (in direction T) the sternum notch (which lies at the middle and bottom of the sternum) and preferably about two inches to the left L of the center line C of the patient's torso. This places the pressing member where it is most likely to stimulate the heart. However, compression applied at nearby locations on the sternum such as at the center line of the sternum, will work almost as well. It should be noted that it is possible to use a rigid torso wrap, which needs to be only of C shape to encircle about 180° of the torso instead of 360°. However, applicant prefers the flexible band for easy storage and low weight.

Figure 3:
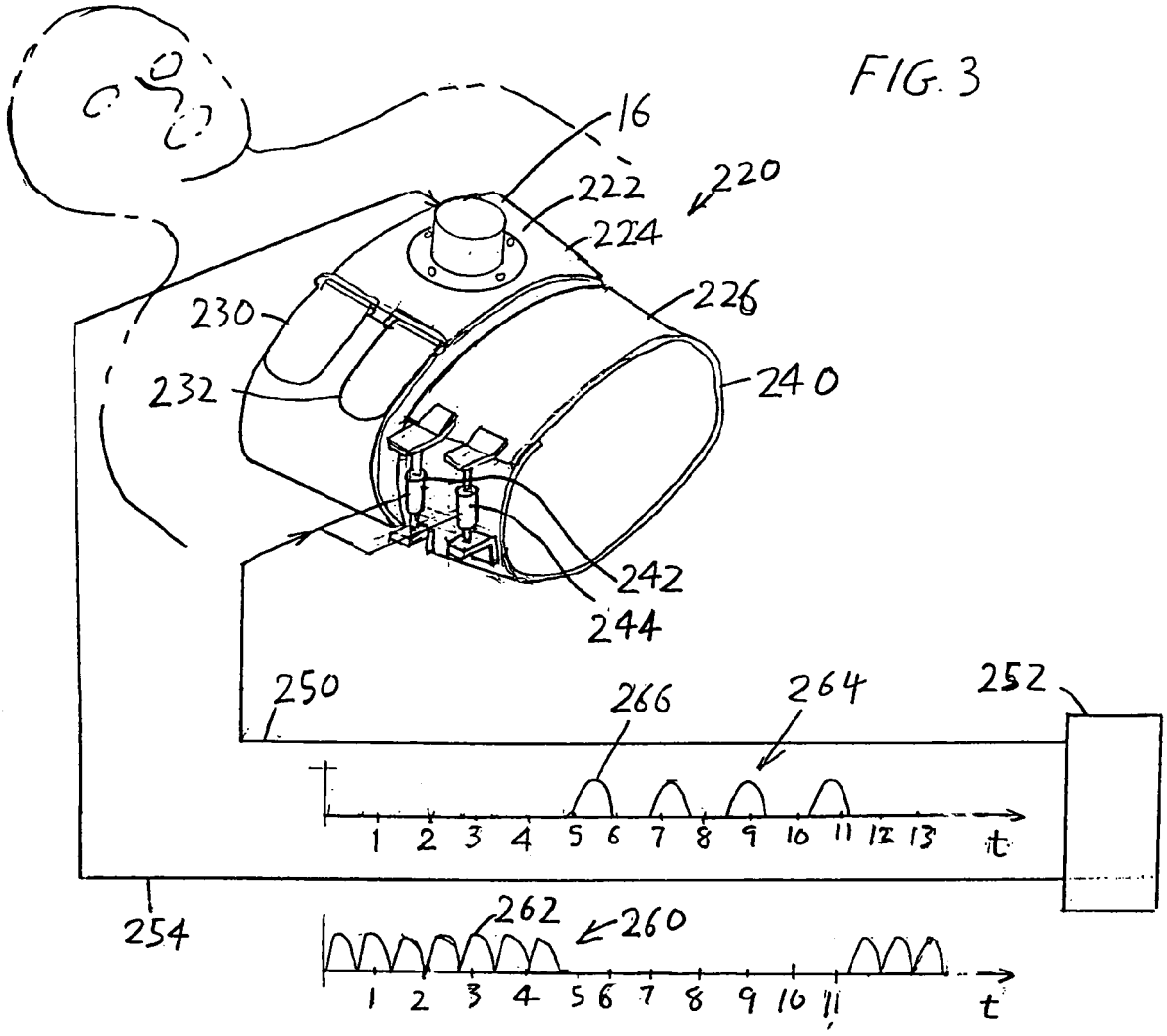
FIG. 3 is an isometric view of apparatus for applying compressions to the patient's sternum to increase circulation, and for also compressing the patient's torso so as to encourage respiration.

In many cases, it is desirable to induce breathing in the patient as well as stimulating the patient's heart. FIG. 3 shows an apparatus 220 that includes a first portion 222 for stimulating a patient's heart and a second portion 226 for stimulating breathing. The apparatus 222 is similar to that of FIGS. 1 and 2, with a wide flexible band 224 that holds an actuator 16. The band has two straps 230, 232 to provide tight band portions at the top and bottom of the wide band. The second portion 226 includes a band 240 that extends in about a full circle (at least 270°) around the person's middle torso, and includes a pair of actuators 242, 244 for controllably tightening the band to compress the middle torso. The actuators 242, 244 are energized by compressed gas pulses delivered over a line 250 from a control 252. The chest compressor actuator 16 is energized by compressed gas pulses delivered through a line 254 that is also connected to the control. A graph 260 shows a sequence of seven chest compression pulses 262 applied along line 254 during a period of about 5 seconds to the chest compressor actuator. Pulses of the same characteristics are applied by the apparatus of FIGS. 1 and 2. Another graph 264 shows pulses 266 along line 250 applied to the breathing actuators 242, 244 to compress the middle chest of the patient about four times during a period of about 6 seconds. It is noted that it is generally desirable to start breathing of the patient by blowing air directly into the mouth of the patient, but many persons will not place their mouth next to the mouth of another person, especially a stranger, and the breathing helping apparatus 226 is a reasonable alternative.

Figure 4:
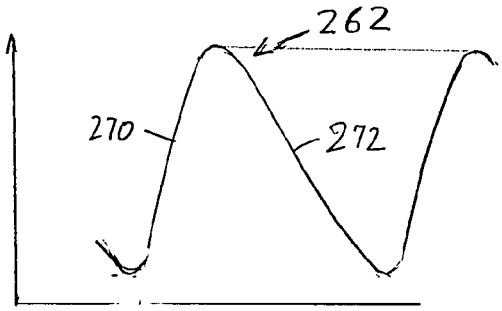
FIG. 4 is a graph showing one of the chest compression pulses applied by the apparatus of FIG. 3.

FIG. 4 shows one of the chest compression pulses 262 applied as gas along the tube and applied as pressure to the patient's chest. The pulse has a rapid rate of increase at 270 and a smaller rate of decrease at 272, with the rate at 272 being less than half the rate at 270.

Although the patient is usually placed in a reclined position, with his back on a horizontal floor or stretcher, the back of the patient may not lie on a horizontal surface, as where it lies on a staircase, although the back portion of the torso wrap still presses against the back of the patient.

Thus, the invention provides an apparatus for applying compressions to the chest of a patient to stimulate blood circulation and a method for installing and operating it, which includes a compact and relatively light weight apparatus to be installed on the patient. This is accomplished by using an actuator energized by pulses of pressured gas, with the pressured gas supplied through an elongated flexible tube from a remote portion of a compression assembly that normally lies on a floor beside the patient. An actuator of small height but long maximum stroke length can be provided by a piston comprising a plurality of piston parts that telescope in one another, and a pressing member attached to the innermost piston part. The orientation of the actuator on the patient is closely controlled by a stabilizer having a larger diameter than that of the pressing member, and which can press against the patient's chest around the actuator to avoid large tilt of the actuator. The torso wrap is preferably in the form of a flexible band, with one side of the band that extends from one side of the actuator forming an eyelet, and the other side of the band which wraps around the patient being pulled through the eyelet to tighten the band on the patient, and with the tightened end portion fixed by Velcro pads.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for applying compressions to the chest of a patient to stimulate blood circulation, comprising:

an energized compressor assembly which includes an actuator and a source of pressured fluid;

a torso wrap that couples to said actuator and that wraps to the back of the patient, so downward forces of the piston against the patient's chest are withstood by upward forces applied to the patient's back;

said actuator includes a cylinder which has an inside surface and a piston with a plurality of telescoping piston parts that telescope in one another and that are exposed to pressured fluid in said cylinder, including an upper piston part that fits closely in said cylinder and a lowermost piston part, and including a pressing member on a lower end of said lowermost piston part for pressing against the patient's chest;

said lowermost piston part having a lower piston inside surface which is exposed to said pressured fluid and which has at least half the diameter of said inside surface of said cylinder.

2. Apparatus for applying compressions to the chest of a patient to stimulate blood circulation, comprising:

an energizable compressor assembly which includes an actuator that has a stationary portion with a vertical axis that extends perpendicular to the patient's chest, and a pressing member for pressing against the patient;

a torso wrap that couples to said actuator and that wraps to the back of the patient, so downward forces of the pressing member against the patient's chest are withstood by upward forces applied to the patient's back;

a saucer-shaped stabilizer that has a center fixed to said actuator stationary portion and a radially outer portion that extends in a curve substantially completely around the axis and that rests against the patient's chest.

* * * * *